US011229295B2

(12) United States Patent
Bovay

(10) Patent No.: US 11,229,295 B2
(45) **Date of Patent: *Jan. 25, 2022**

(54) SCREEN

(71) Applicant: Webaround, LLC, Highland, MI (US)

(72) Inventor: Linda Bovay, Highland, MI (US)

(73) Assignee: Webaround, LLC, Highland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/941,893

(22) Filed: Jul. 29, 2020

(65) Prior Publication Data

US 2020/0352339 A1 Nov. 12, 2020

Related U.S. Application Data

(63) Continuation of application No. 16/001,040, filed on Jun. 6, 2018, now Pat. No. 10,758,053.

(60) Provisional application No. 62/597,536, filed on Dec. 12, 2017.

(51) Int. Cl.
*A47C 7/62* (2006.01)
*A47G 5/00* (2006.01)

(52) U.S. Cl.
CPC . *A47C 7/62* (2013.01); *A47G 5/00* (2013.01)

(58) Field of Classification Search
CPC ..... A47C 7/62; A47C 7/66; A47G 5/00
USPC ..... 160/351, 354, 368.1; 297/184.1, 184.11
See application file for complete search history.

(56) References Cited

U.S. PATENT DOCUMENTS 110,844 A ‡ 1/1871 Fritsch ..... A47B 47/027 211/180
973,936 A ‡ 10/1910 Graves ..... A47G 5/00 160/135
1,915,504 A * 6/1933 Stokby ..... A47C 1/146 160/351
2,349,193 A ‡ 5/1944 Pass ..... A47C 31/11 297/225
2,731,997 A ‡ 1/1956 Muth et al. ..... A45C 9/00 383/4
2,807,315 A ‡ 9/1957 Manne ..... A47C 7/56 297/188.06

(Continued)

FOREIGN PATENT DOCUMENTS

DE 2122100 B2 * 11/1972 ..... A47C 7/666
DE 10024367 A1 * 11/2001 ..... A47G 5/00
GB 2269744 A * 2/1994 ..... A47K 3/38

*Primary Examiner* — Brian D Mattei
*Assistant Examiner* — Joseph J. Sadlon
(74) *Attorney, Agent, or Firm* — Black, McCuskey, Souers & Arbaugh LPA

(57) ABSTRACT

A screen mountable on a chairback of a chair can include a primary panel, a vertical strap, and a brace assembly. The primary panel can have a front and back sides, extend between first and second lateral edges and between top and bottom vertical edges. The vertical strap can be fixed to the front side at first and second ends and extend around the chairback. The vertical strap can be formed to elastically stretch around the chairback. The brace assembly can be fixed to the front side to urge the top vertical edge forward. A second end of the brace assembly can be selectively engageable with the front side at a second position above the first position. The second end can be engaged with the front side in operation and disengaged from the front side when not in operation.

18 Claims, 12 Drawing Sheets

(56) References Cited

U.S. PATENT DOCUMENTS 2,872,242 A ‡ 2/1959 Whartman ..... B60J 1/2005 296/91
2,990,008 A * 6/1961 Bien ..... B60N 2/882 297/397
3,172,702 A * 3/1965 Rose ..... B60N 2/882 297/397
3,329,971 A ‡ 7/1967 Shelby ..... A47C 7/66 2/69
3,540,775 A ‡ 11/1970 DeFleur ..... B60R 7/043 297/188.2
3,580,633 A * 5/1971 Priest ..... A47C 3/16 297/184.1
3,645,556 A * 2/1972 Kobori ..... B60N 2/803 280/749
3,848,921 A * 11/1974 Rhodes ..... B63B 29/04 297/184.1
4,154,478 A ‡ 5/1979 Cohune ..... A47C 7/383 297/397
4,419,982 A ‡ 12/1983 Eckels ..... E06B 9/40 126/625
4,440,443 A * 4/1984 Nordskog ..... B64D 11/0606 297/397
4,597,608 A * 7/1986 Duffy ..... B60J 11/08 160/370.21
4,639,946 A ‡ 2/1987 Koenig ..... A41B 13/00 2/49.1
4,676,549 A ‡ 6/1987 English ..... B60N 2/6027 297/224
4,687,248 A ‡ 8/1987 Ross ..... A47C 4/52 190/2
4,754,987 A ‡ 7/1988 Williams ..... A61G 5/00 280/304.1
4,807,929 A ‡ 2/1989 Balsbaugh ..... A47C 3/04 297/188.04
4,823,822 A ‡ 4/1989 Maya ..... E04H 15/58 135/19.5
4,960,293 A ‡ 10/1990 Bottinick ..... B60R 21/026 119/712
5,067,770 A ‡ 11/1991 Hassell, Jr. ..... B60N 2/28 135/19.5
5,131,575 A ‡ 7/1992 Charest ..... A45F 4/02 224/155
5,154,473 A * 10/1992 Joranco ..... A47C 7/66 297/184.15
5,203,363 A * 4/1993 Kidwell ..... A47C 7/66 135/90
D338,779 S ‡ 8/1993 Albert ..... B60N 2/6018 D12/416
5,249,592 A ‡ 10/1993 Springer ..... E04H 15/40 135/126
5,393,013 A ‡ 2/1995 Schneider ..... B64D 11/0023 160/351
5,411,318 A ‡ 5/1995 Law ..... A47C 7/74 297/180.11
5,524,694 A * 6/1996 Arapis ..... B60J 1/2011 160/354
5,544,793 A ‡ 8/1996 Harrop ..... A45F 4/02 224/153
5,620,040 A ‡ 4/1997 Swanner ..... B60J 7/10 160/264
5,652,960 A ‡ 8/1997 Kaknevicius ..... A41D 1/215 2/104
5,690,380 A ‡ 11/1997 Waters ..... A47C 31/11 297/219.1
5,707,099 A * 1/1998 Schrader ..... B60N 2/90 296/180.1
5,713,624 A ‡ 2/1998 Tower ..... B60J 1/2011 119/712
5,819,999 A ‡ 10/1998 Tennant ..... A45F 4/02 224/155
5,860,697 A ‡ 1/1999 Fewchuk ..... A47C 3/04 297/239
5,879,048 A * 3/1999 Tower ..... B60J 1/2011 296/152
6,022,072 A ‡ 2/2000 Moyer ..... A47C 7/62 248/909
6,109,282 A ‡ 8/2000 Yoon ..... E04H 15/40 135/124
6,145,932 A ‡ 11/2000 Hamel-Nyhus ..... A47D 15/006 297/219.12
6,170,100 B1 ‡ 1/2001 Le Gette ..... A47G 9/062 297/219.1
6,170,680 B1 * 1/2001 Hung ..... A45D 44/02 211/119.007
6,216,927 B1 ‡ 4/2001 Meritt ..... B60R 11/02 224/275
6,296,002 B1 ‡ 10/2001 Tashchyan ..... A47C 4/283 135/115
6,447,059 B1 ‡ 9/2002 Jackson ..... A47C 31/11 297/188.06
6,652,026 B2 ‡ 11/2003 Toyota ..... B60N 2/6054 297/229
6,655,731 B2 ‡ 12/2003 Martin ..... A47C 1/023 297/23
6,695,373 B1 * 2/2004 Meise ..... B60R 21/06 296/24.43
6,698,828 B1 * 3/2004 Chan ..... A47C 4/06 297/51
6,755,232 B1 ‡ 6/2004 Holland ..... B65D 88/125 160/368.1
6,764,133 B2 ‡ 7/2004 Osato ..... A47D 13/102 297/184.13
6,823,883 B1 ‡ 11/2004 Sears ..... E04H 15/003 135/115
6,827,262 B2 ‡ 12/2004 McClure ..... G07C 13/00 235/386
6,848,460 B2 ‡ 2/2005 Zheng ..... E04H 15/324 135/126
7,011,367 B2 ‡ 3/2006 Riley ..... A47C 31/11 297/219.1
D553,894 S ‡ 10/2007 Springer ..... A47G 5/00 D6/611
7,302,957 B2 ‡ 12/2007 Ross ..... E04H 15/40 135/117
7,322,626 B2 ‡ 1/2008 Thomas ..... B60R 21/12 296/24.3
7,427,101 B1 ‡ 9/2008 Zernov ..... A47C 7/66 135/96
7,446,823 B2 ‡ 11/2008 Zheng ..... B60R 11/0211 297/188.04
7,644,984 B2 ‡ 1/2010 Chalhoub ..... B60N 2/58 297/113
7,686,392 B2 ‡ 3/2010 Kenny ..... A47C 7/74 297/180.11
7,810,880 B2 ‡ 10/2010 Spellman ..... B60R 11/00 297/188.06
7,891,733 B1 ‡ 2/2011 Clarke ..... A47C 7/62 211/118
7,896,433 B2 ‡ 3/2011 Mayer ..... B60N 2/686 297/188.06
8,087,341 B2 * 1/2012 Adler ..... E04H 15/02
8,167,367 B1 * 5/2012 Martinez ..... A47C 7/748 297/180.12
8,186,755 B2 ‡ 5/2012 Lovley ..... A47C 4/286 135/119
8,342,226 B2 ‡ 1/2013 Zheng ..... B60N 2/28 135/19.5
8,434,805 B1 ‡ 5/2013 Bonniville ..... B60R 21/12 280/749
8,500,199 B2 ‡ 8/2013 Paulin ..... A47B 13/083 297/219.1
8,534,755 B2 ‡ 9/2013 Nickerson ..... A45F 4/02 297/219.1
8,556,337 B1 ‡ 10/2013 Cornitius-Cary ..... A47C 7/021 224/275
8,708,027 B2 ‡ 4/2014 Howie ..... E04H 15/06 160/368.1

(56) References Cited

U.S. PATENT DOCUMENTS 8,746,790 B2 ‡ 6/2014 Beaty Bishop ..... A01K 1/033 297/188.08
9,108,733 B2 ‡ 8/2015 Sizelove ..... G06F 3/04842
9,220,344 B2 * 12/2015 Birch ..... B60N 2/882 297/397
9,322,197 B2 ‡ 4/2016 Squires ..... A47C 7/62
9,383,113 B1 ‡ 7/2016 Renwick ..... A47C 7/66
9,390,571 B1 * 7/2016 Kupfer ..... H02J 7/35
9,445,672 B2 * 9/2016 Demosthene ..... A47C 31/11
9,493,963 B2 * 11/2016 Maginot ..... A47C 7/66
9,516,950 B1 ‡ 12/2016 Osweiler ..... A47C 1/11
9,797,157 B2 ‡ 10/2017 Lovley, II ..... E04H 15/58 135/19.5
9,814,315 B2 ‡ 11/2017 Osweiler ..... A47C 7/62
9,930,434 B2 ‡ 3/2018 Domash ..... H04R 1/026
9,936,811 B2 * 4/2018 Rowe, Jr. ..... E04H 15/02
10,575,658 B2 ‡ 3/2020 Romero ..... A47D 15/006
2002/0114539 A1 * 8/2002 Strevey ..... A45C 3/004 383/13
2004/0251717 A1 ‡ 12/2004 Tamura ..... A47C 4/52 297/17
2009/0151827 A1 * 6/2009 Thompson ..... B60J 11/06 150/154
2009/0184077 A1 * 7/2009 Curet ..... A47B 43/006 211/117
2014/0290879 A1 * 10/2014 De La Fuente Sanchez ..... B60N 2/882 297/397
2016/0090029 A1 ‡ 3/2016 Levytsky ..... B60J 11/04 340/473
2018/0325289 A1 * 11/2018 Fung-A-Wing ..... A47C 7/66 135/90
2019/0159597 A1 * 5/2019 Simhan ..... A47C 7/66

* cited by examiner
‡ imported from a related application

SCREEN

CROSS-REFERENCE TO RELATED APPLICATIONS

This application is a continuation of U.S. patent application Ser. No. 16/001,040 for a SCREEN, filed on Jun. 6, 2018, which is hereby incorporated by reference in its entirety. This application also claims the benefit of U.S. Provisional Patent Application Ser. No. 62/597,536 for a SCREEN, filed on Dec. 12, 2017, which is hereby incorporated by reference in its entirety.

BACKGROUND

1. Field

The present disclosure relates to a privacy shells, screens, separators or the like, which are mountable on a chair.

2. Description of Related Prior Art

U.S. Patent No. D618,948 discloses a screen mountable on a chair.

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

SUMMARY

A screen mountable on a chairback of a chair can include a primary panel, a horizontal strap, and a brace assembly. The primary panel can have a front side and a back side. The primary panel can extend laterally between first and second lateral edges and vertically between top and bottom vertical edges. The front side can be operable to confront and contact a back side of the chairback in operation. The primary panel can be sized to extend beyond a perimeter of the chairback in operation to conceal items positioned behind the chairback. The horizontal strap can be fixed to the front side at first and second ends. The horizontal strap can be configured to extend laterally around a front side of the chairback in operation whereby the chairback is positioned between the horizontal strap and the primary panel in operation. The horizontal strap can be formed from elastic material whereby the horizontal strap is configured to elastically stretch around the chairback in operation. The brace assembly can be fixed to the front side at a first end and extend to a second end. The first end of the brace assembly can be fixed to the front side at a first position closer to the bottom vertical edge than the horizontal strap. The brace assembly can be configured to confront and contact the back side of the chairback in operation to urge the top vertical edge forward. The second end can be selectively engageable with the front side at a second position spaced closer to the top vertical edge than the first position. The second end can be engaged with the front side in operation and disengaged from the front side when not in operation.

BRIEF DESCRIPTION OF THE DRAWINGS

The detailed description set forth below references the following drawings.

DETAILED DESCRIPTION

Figure 1:
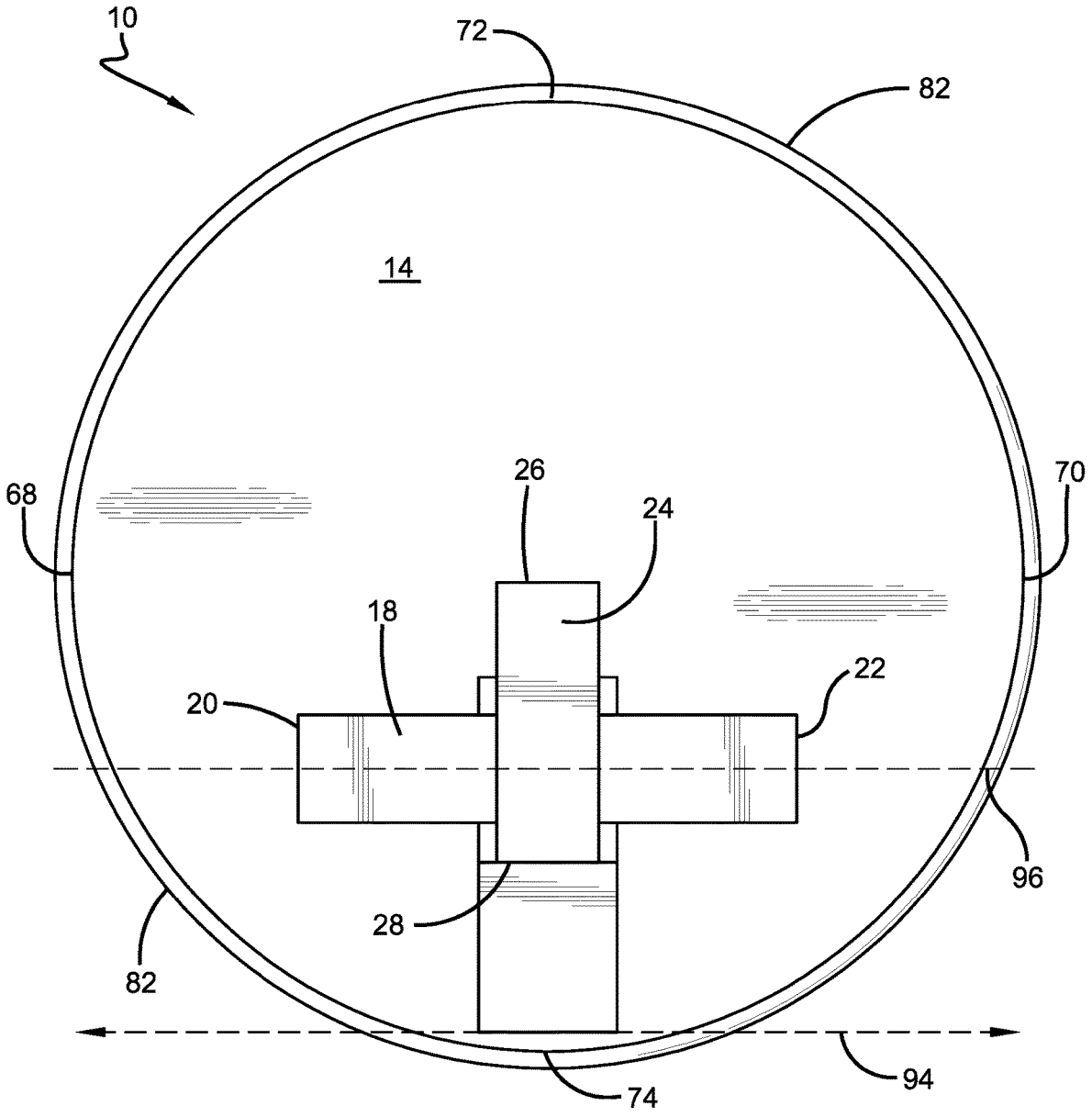
FIG. 1 is a first front view of a screen according to an exemplary embodiment of the present disclosure.

The present disclosure, as demonstrated by the exemplary embodiment described below, can provide an improved screen 10 for mounting on the back of a chair. D618,948 is hereby incorporated in its entirety. In operation, the screen 10 can conceal items positioned behind the chairback.

The screen 10 can include a primary panel 12. The primary panel 12 can have a front side 14 and a back side 16. The exemplary primary panel 12 extends laterally between first and second lateral edges 68, 70. The exemplary primary panel 12 also extends vertically between top and bottom vertical edges 72, 74. The front side 14 operable to confront and contact a back side 76 of a chairback 78 in operation. The primary panel 12 is sized to extend beyond at least part of a perimeter 80 of the chairback 78 in operation to conceal items positioned behind the chairback 78.

Figure 3:
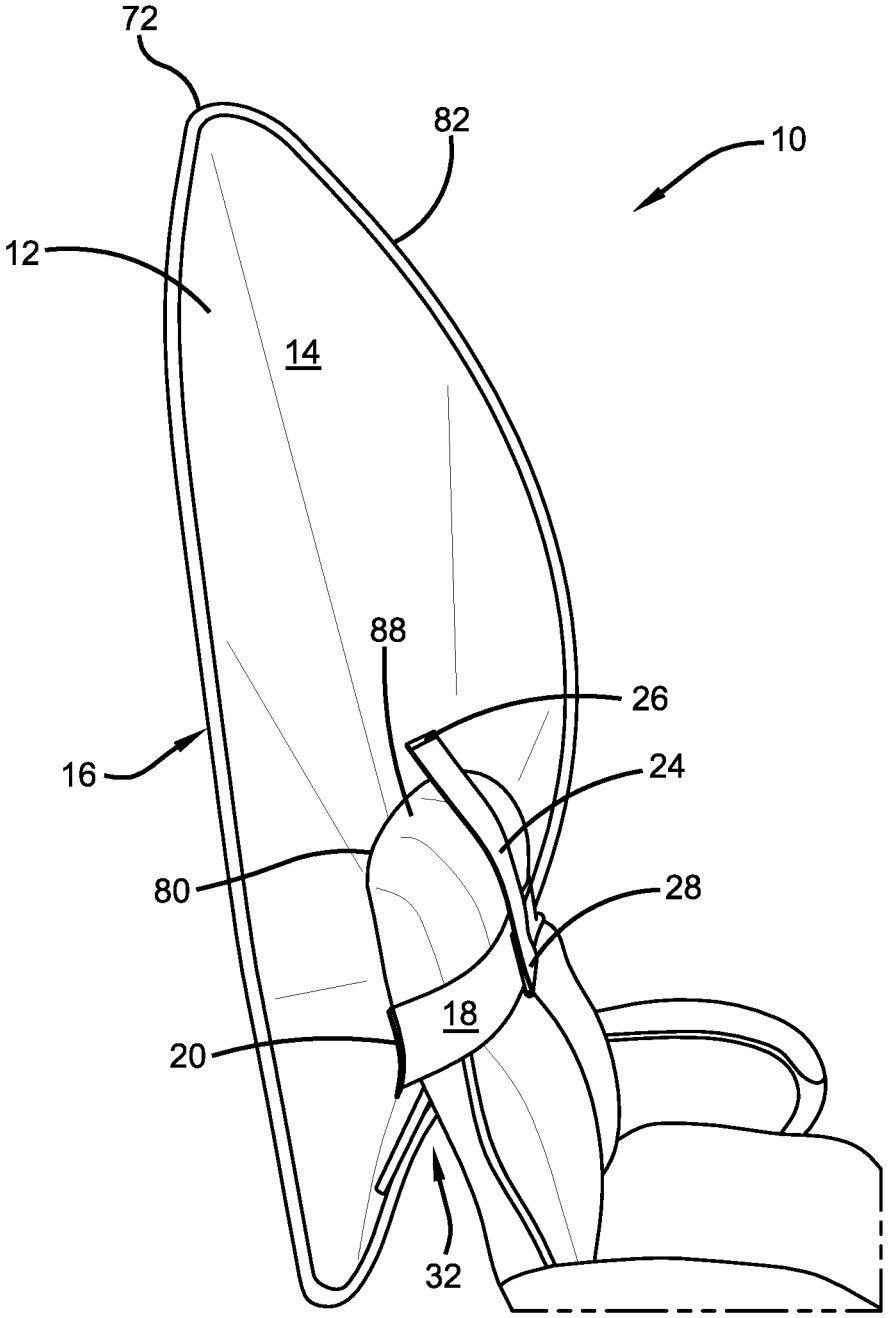
FIG. 3 is a first perspective view of the exemplary screen in operation.
Figure 4:
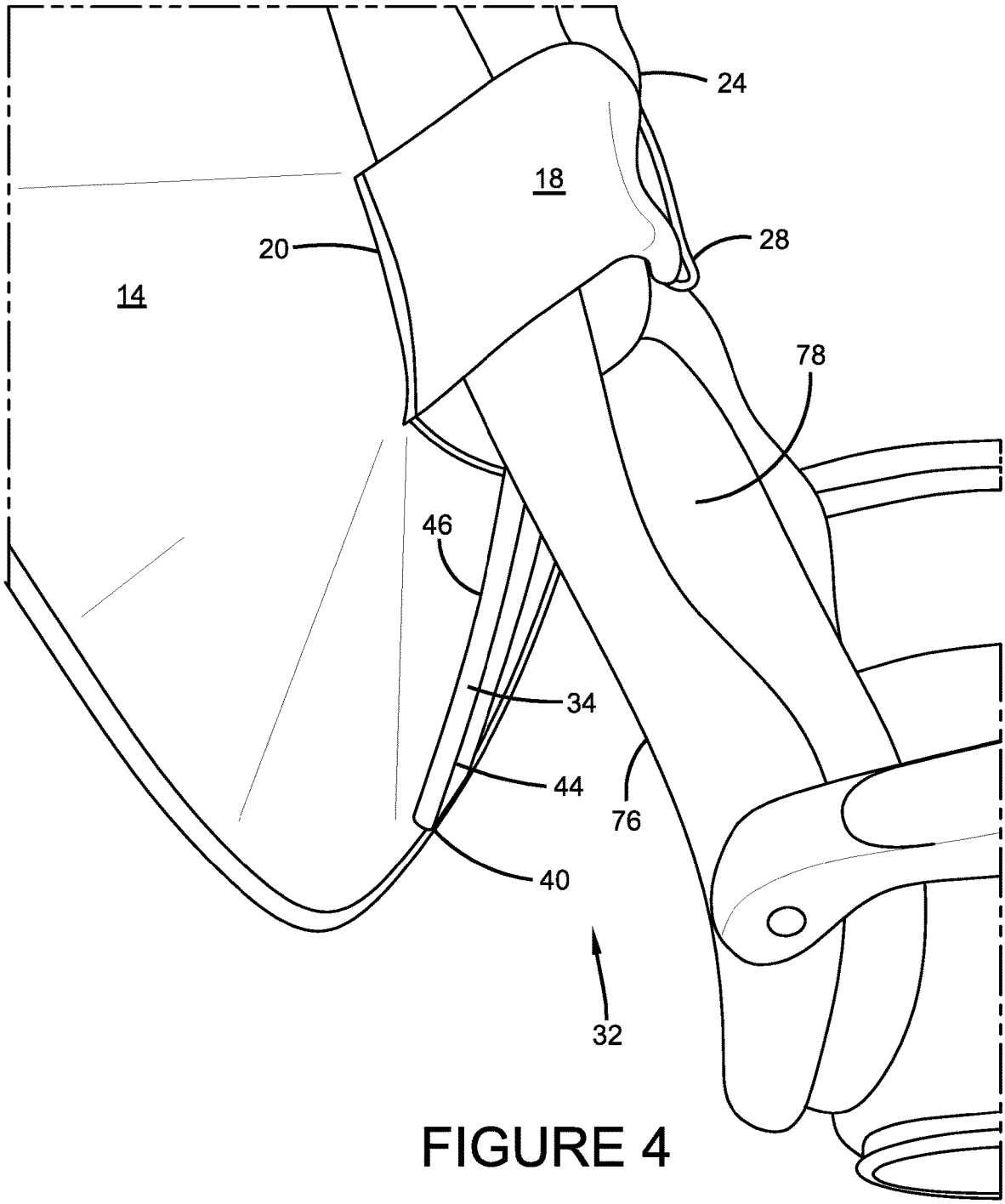
FIG. 4 is a second perspective view of the exemplary screen in operation.
Figure 5:
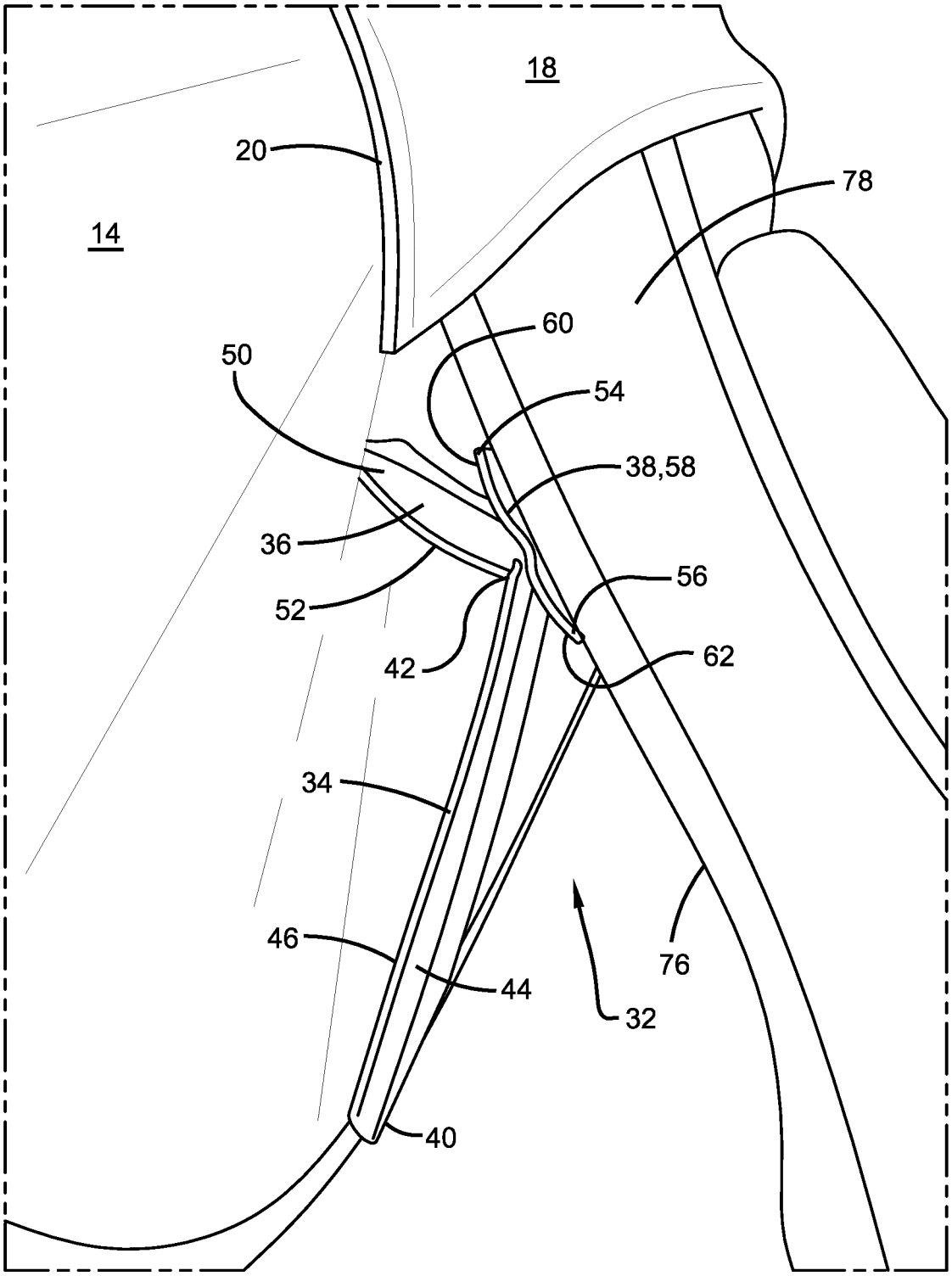
FIG. 5 is a third perspective view of the exemplary screen in operation.

The primary panel 12 can be formed in part from foldable material such as fabric. The primary panel 12 can also include a wire frame. The wire frame can be positioned in a pocket defined by the foldable material, as shown in FIG. 5 of D618,948, which is hereby incorporated by reference. The pocket and wire frame can extend about and define a perimeter 82 of the primary panel 12. The primary panel 12 can be folded for storage when not in use. FIG. 3 shows the primary panel 12 in use.

Figure 10A:
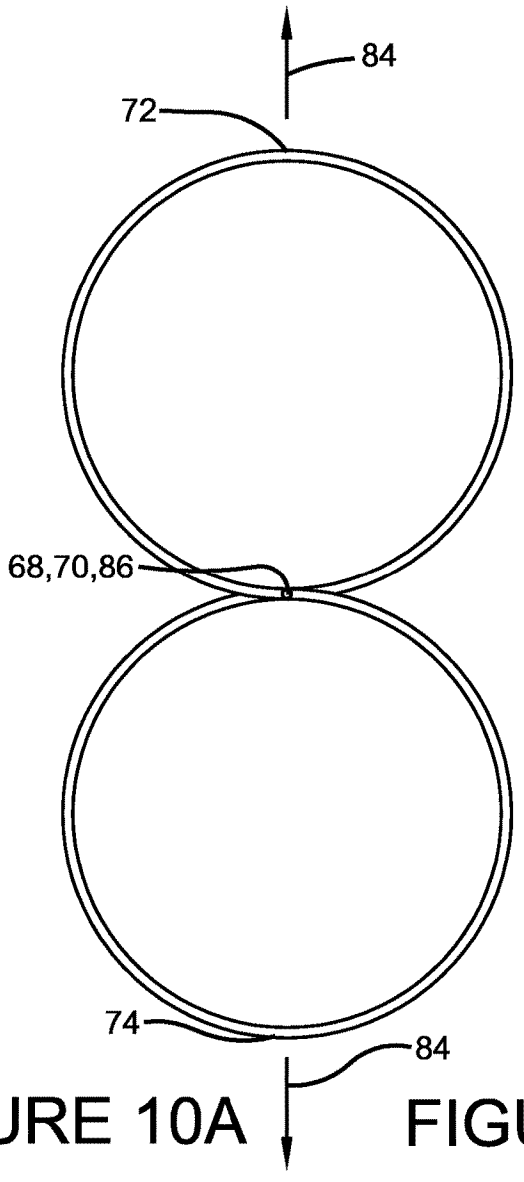
FIGS. 10A-10C are views of the exemplary screen being twice-folded.
Figure 10B:
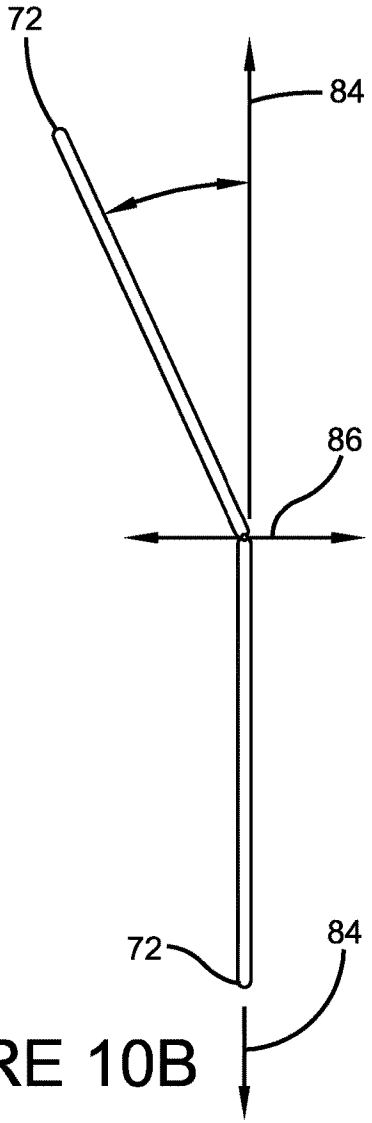
Figure 10C:
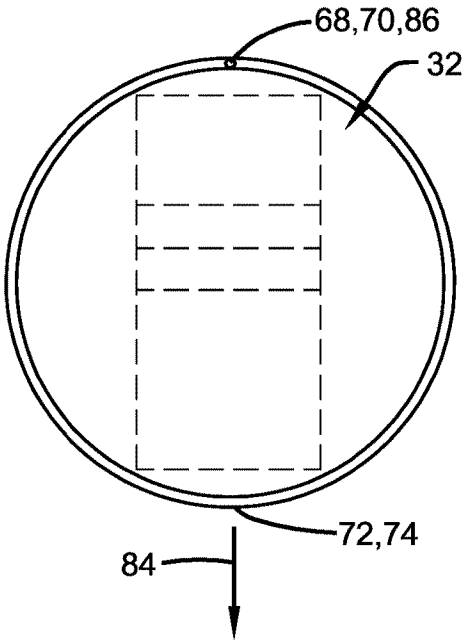
Figure 11:
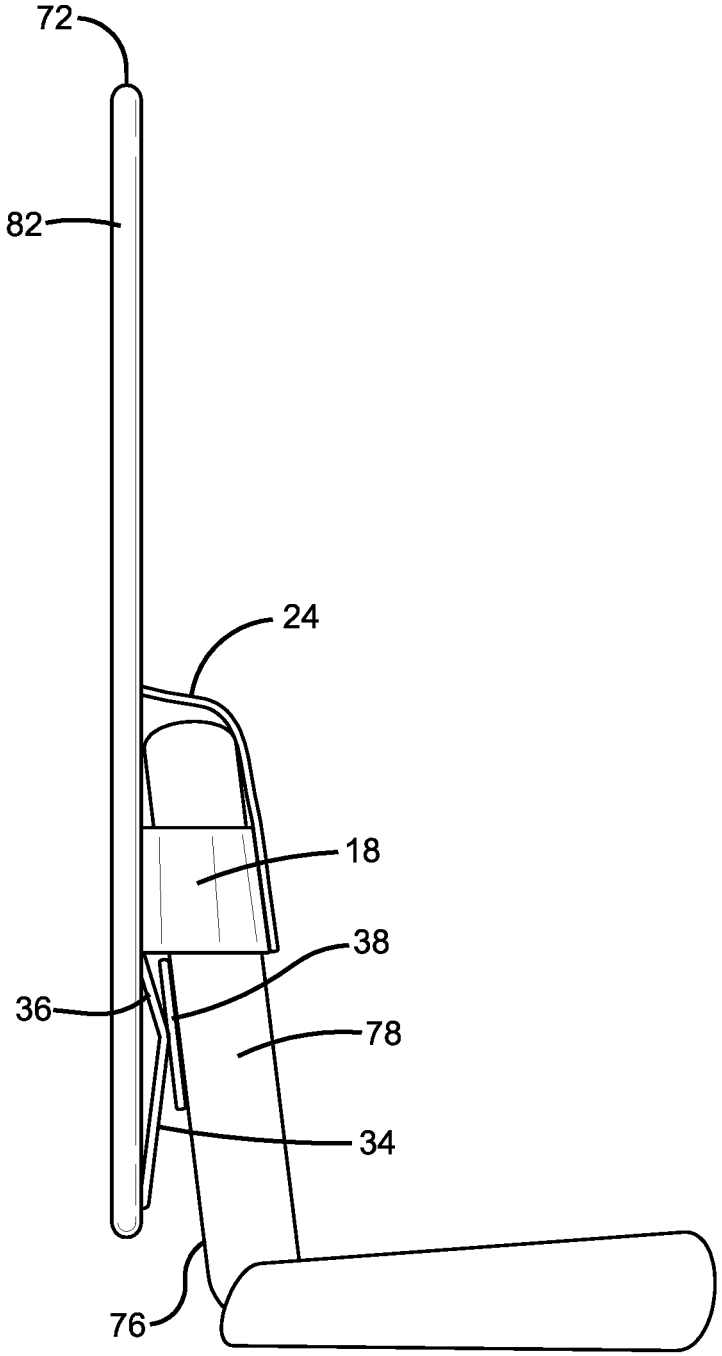
FIG. 11 is a side view of the exemplary screen when in operation.
Figure 12:
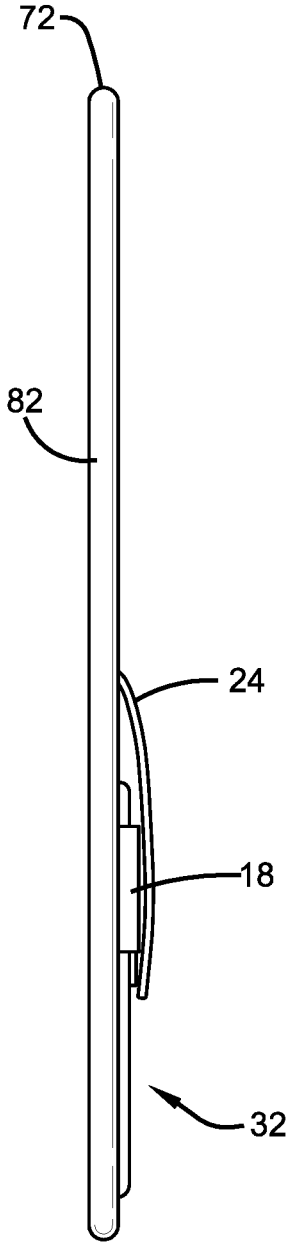
FIG. 12 is a side view of the exemplary screen when not in operation, but unfolded.
Figure 13:
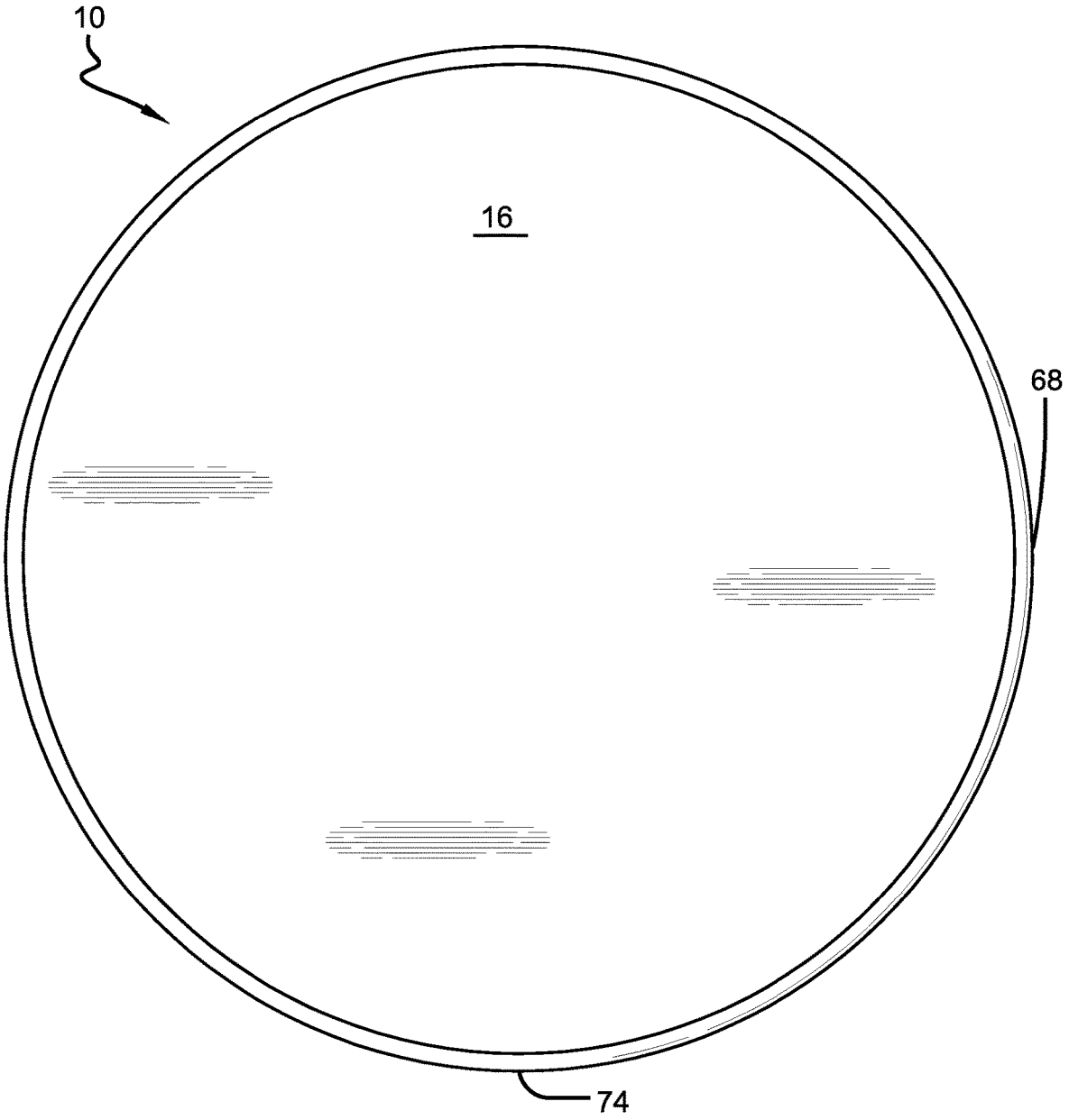
FIG. 13 is a rear view of the exemplary screen.

FIGS. 10A-10C show the screen 10 during the process of twice-folding. Axes 84 and 86 are included in FIGS. 10A-10C for reference. In FIGS. 10A and 10C the axis 86 extends into and out of the page. FIGS. 10A and 10C are front views and FIG. 10B is a side view. During an initial or first folding step, the lateral edges 68 and 70 can be brought together. This is shown in FIG. 10A. This can cause the wire frame of the primary panel 12 to form the shape of the number eight. Next, the user can bring the top and bottom vertical edges 72 and 74 together. This is shown in FIG. 10B. This can cause the wire frame of the primary panel 12 to form overlapping circles, shown in FIG. 10C.

The screen 10 can also include a horizontal strap 18. The horizontal strap 18 can extend between first and second ends 20, 22. The horizontal strap 18 can be fixed to the front 14 of the primary panel 12 at the ends 20, 22, such as by sowing. The exemplary horizontal strap 18 is configured to extend laterally around a front side of the chairback 78 in operation whereby the chairback 78 is positioned between the horizontal strap 18 and the primary panel 12 in operation. The horizontal strap 18 can be formed from an elastic material so that, in operation, when the chairback 78 is positioned between the primary panel 12 and the horizontal strap 18, the horizontal strap 18 is stretched.

The screen 10 can also include a vertical strap 24. The vertical strap 24 can extend between first and second ends 26, 28. The vertical strap 24 can be fixed to the front 14 of the primary panel 12 at the end 26, such as by sowing. The exemplary vertical strap 24 is configured to extend vertically over a top 88 of the chairback 78 in operation whereby the top 88 of the chairback 78 is positioned between the vertical strap 24 and the primary panel 12 in operation. The vertical strap 24 can be formed from elastic material whereby the vertical strap 24 is configured to elastically stretch around the top 88 of the chairback 78 in operation. The end 28 can be releasably connectable to the horizontal strap 18, such as with matching patches of hook and loop fasteners. In the exemplary embodiment, a patch 30 can be fixed on the end 28 and connect directly to the horizontal strap 18. The vertical strap 24 can be formed from a relatively non-elastic material so that, in operation, when the chairback 78 is positioned between the primary panel 12 and the vertical strap 24, the vertical strap 24 inhibits the primary panel 12 from tipping backward.

Figure 6:
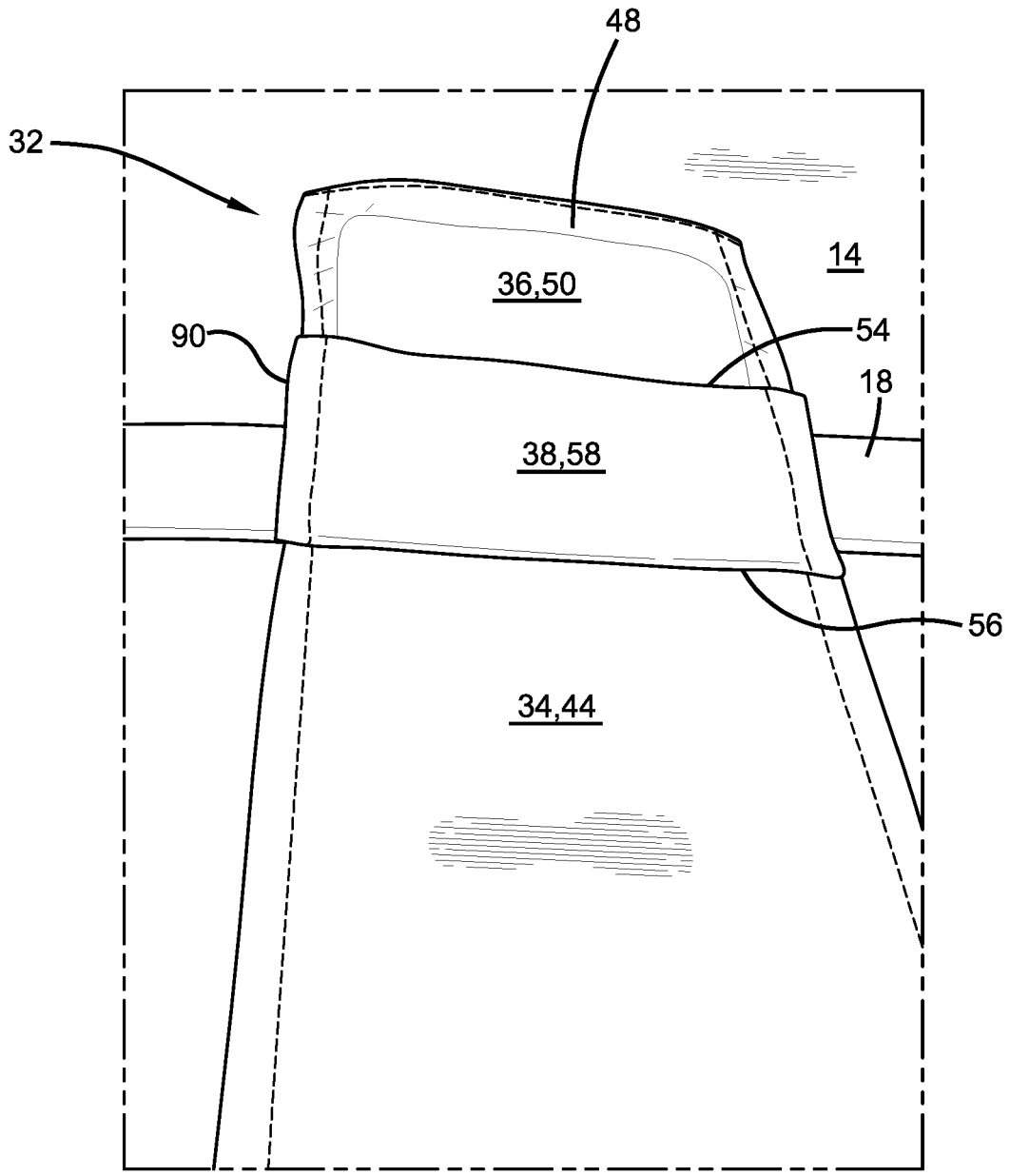
FIG. 6 is a fourth perspective view of the exemplary screen.
Figure 7:
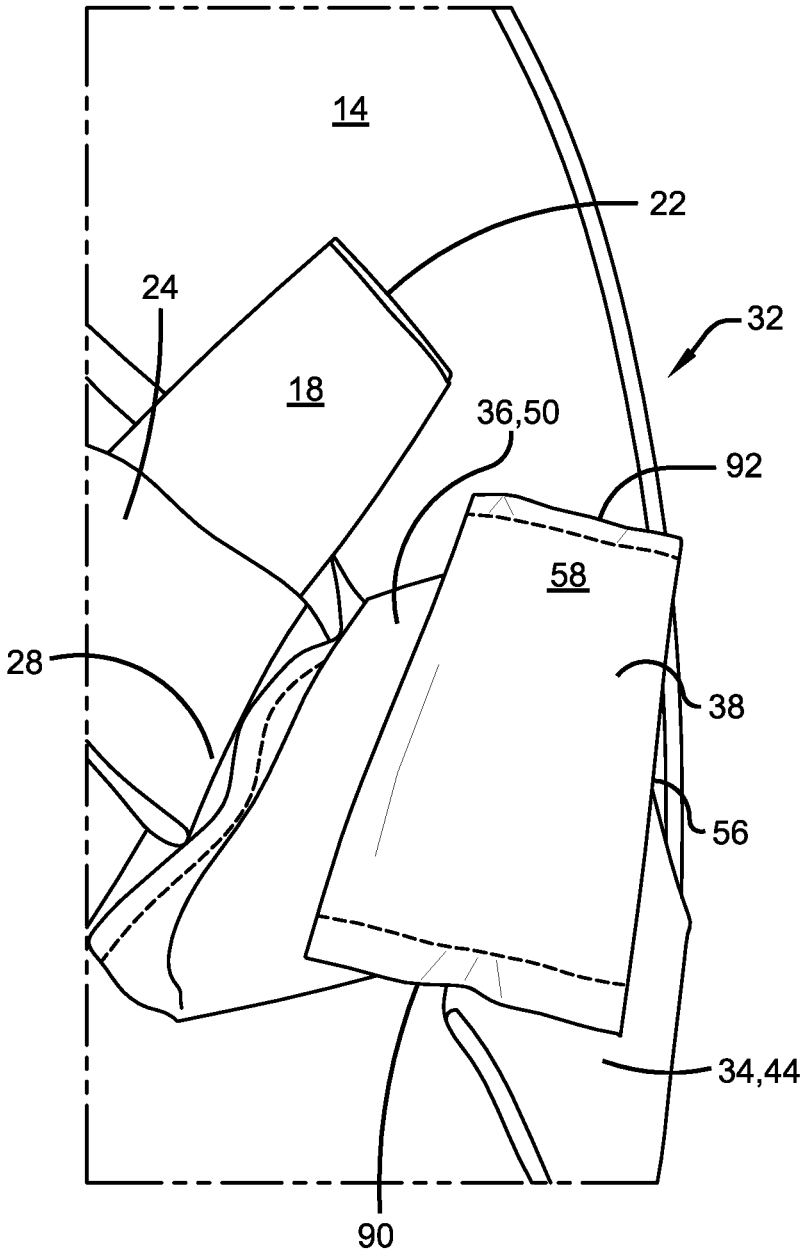
FIG. 7 is a fifth perspective view of the exemplary screen.
Figure 8:
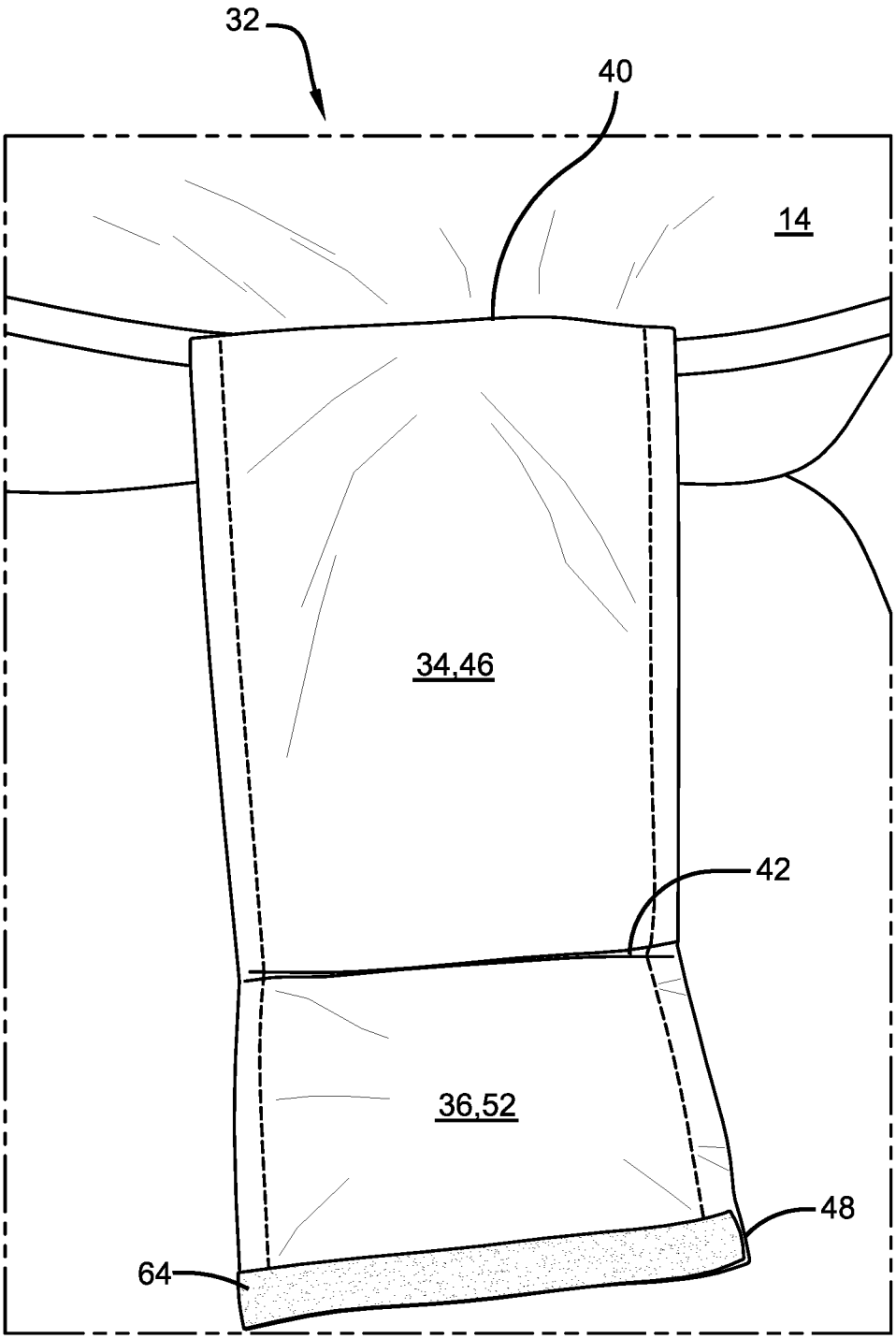
FIG. 8 is a sixth perspective view of the exemplary screen.
Figure 9:
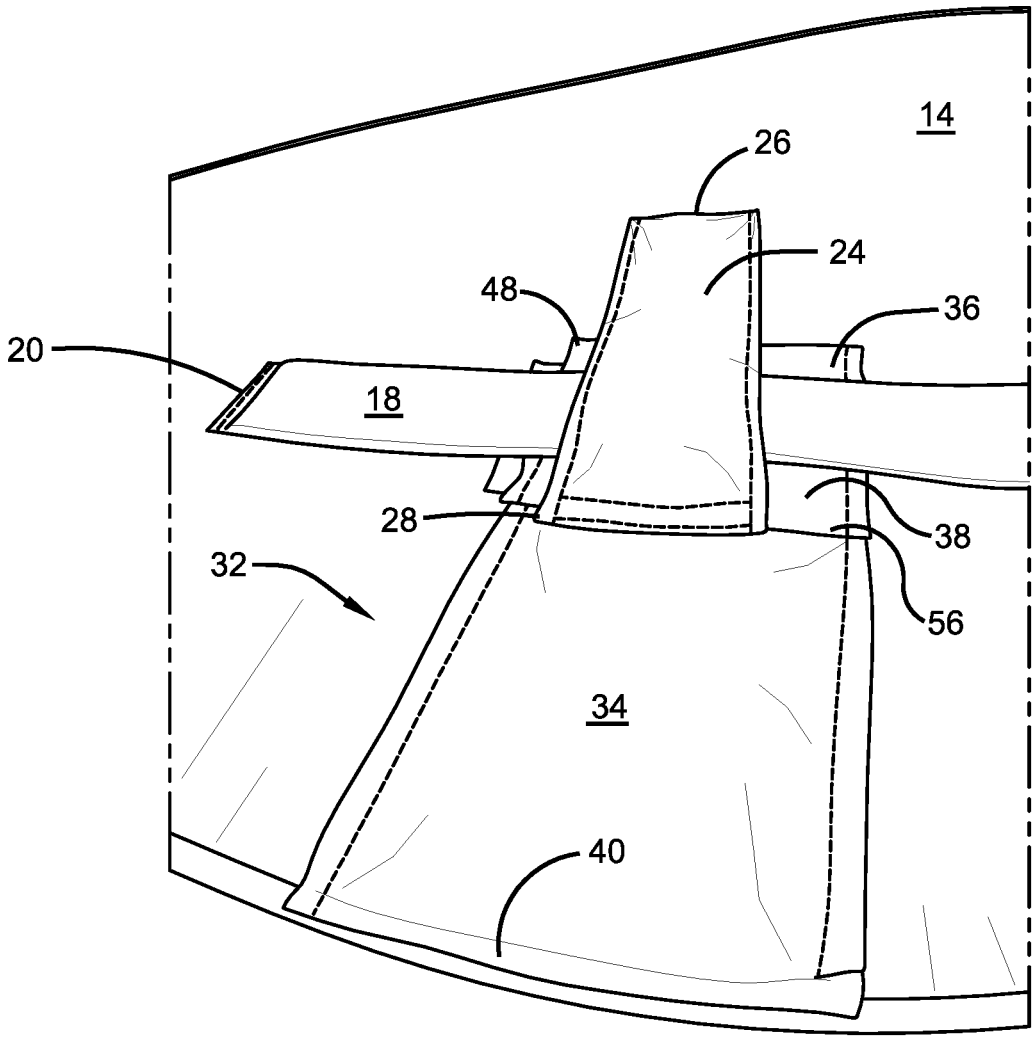
FIG. 9 is a seventh perspective view of the exemplary screen.

The screen 10 can also include a brace assembly 32. The brace assembly 32 can further prevent the primary panel 12 from tipping backward. The exemplary brace assembly 32 is configured to confront and contact the back side 76 of the chairback 78 in operation to urge the top vertical edge 72 forward. The exemplary brace assembly 32 is fixed to the front side 14 at a first end 40 and extends to a second end 48. The first end 40 of the exemplary brace assembly 32 is fixed to the front side 14 at a first position closer to the bottom vertical edge 74 than the horizontal strap 18. The second end 48 is selectively engageable with the front side 14 at a second position spaced closer to the top vertical edge 72 than the first position. The exemplary second position at which the exemplary brace assembly 32 selectively connects to the primary exemplary panel 12 is positioned between the primary exemplary panel 12 and the horizontal strap 18 (underneath the strap 18). The second end 48 is engaged with the front side 14 in operation and disengaged from the front side 14 when not in operation. FIG. 6 shows the exemplary brace assembly 32 laying on the horizontal strap 18 when not in operation and FIG. 1 shows the exemplary brace assembly 32 laying under the horizontal strap 18 when not in operation. The second end 48 is closer to the top vertical edge 72 than the horizontal strap 18 when the exemplary brace assembly 32 is laying flat on the primary panel 12 and the primary panel 12 is unfolded, as shown in FIG. 1.

The exemplary brace assembly 32 is configured to lay flat on the primary panel 12 when not in operation and defines a length when laying flat. In FIG. 1, the length is defined along an axis extending between the top and bottom vertical edges 72, 74. As shown in FIG. 1, the length of the exemplary brace assembly 32 is less than one-half a distance between the top vertical edge 72 and the bottom vertical edge 74. This allows the brace assembly 32 to fit within the twice-folded primary panel 12, enhancing the flatness of the screen 10 when stored. The first end of the vertical strap 24 and the first end of the exemplary brace assembly 32 are positioned on opposite sides of the horizontal strap 18.

As discussed above, the primary panel 12 is twice-foldable into a circular shape when not in operation. The exemplary brace assembly 32 is sized to remain flat when the primary panel 12 has been twice-folded. The outline of the exemplary brace assembly 32 is shown in phantom in FIG. 10C. The exemplary brace assembly 32 is thus contained within a perimeter of the primary exemplary panel 12 when the primary exemplary panel 12 has been twice-folded.

The exemplary brace assembly 32 includes a plurality of panels or members pivotally interconnected to one another. In the present disclosure, the terms panel and member are used interchangeably, but in other embodiments a member could be non-planar and/or non-cubic. The exemplary brace assembly 32 includes a first exemplary panel 34, a second exemplary panel 36, and a third exemplary panel 38. Each of the exemplary panels 34, 36, 38 can be constructed generally similarly. Each of the exemplary panels 34, 36, 38 can include a rigid plate enclosed by foldable material such as fabric.

The first exemplary panel 34 defines the first end 40. The first exemplary panel 34 can extend a first length between the first end 40 and an intermediate end 42. The first exemplary panel 34 can have an outer surface 44 and an inner surface 46. The first exemplary panel 34 can be fixed to the front 14 of the primary exemplary panel 12 at the end 40, such as by sowing. The first exemplary panel 34 is engaged with the primary exemplary panel 12 for pivoting movement about a first axis 94, referenced in FIG. 1.

The second exemplary panel 36 can extend between the end 42 and the end 48. The second panel 36 defines the second end 48 of the exemplary brace assembly 32 and extends a second length between the ends 42 and 48. The second exemplary panel 36 can have an outer surface 50 and an inner surface 52. The second exemplary panel 36 can be fixed to the first exemplary panel 34 at the end 42, such as by sowing or by a common piece of flexible material containing both of the rigid plates that are components of the exemplary panels 34, 36. The exemplary end 42 is a living hinge permitting freely-pivoting movement between the exemplary panels 34 and 36.

The third exemplary panel 38 defines a substantially planar outer surface 58 configured to engage the back side 76 of the chairback 78 in operation. The third exemplary panel 38 also defines "inner" surfaces 60, 62. The outer planar surface 58 extends between panel edges 54, 56 to define a height. The outer planar surface 58 extends laterally between panel edges 90, 92 to define a width.

The third exemplary panel 38 can be fixed to the first exemplary panel 34 and the second exemplary panel 36 at the end 42, such as by sowing or by a common piece of flexible material containing all of the rigid plates that are parts of the exemplary panels 34, 36, 38. The exemplary surfaces 60, 62 are similarly sized and are on opposite sides of the end 42. The end 42 can be a living hinge between all three exemplary panels 34, 36, 38 permitting freely-pivoting movement between the exemplary panels 34, 36 and 38. The first exemplary panel 34 and the second exemplary panel 36 and the third exemplary panel 38 are thus pivotally interconnected to one another at a single living hinge. Each of the third exemplary panel 38 and the first exemplary panel 34 and the second exemplary panel 36 are pivotal relative to the other two exemplary panels. The end/joint 42 can be positioned midway between the ends 54, 56. The exemplary planar surface 58 is operable to pivot in response to a configuration of the back side 76 of the chairback 78 to lie flush with the back side 76 of the chairback 78.

The third exemplary panel 38 is engaged with the at least one of the first panel and the second panel for pivoting movement about an axis. The axis of pivoting movement of the panel 38 is in a plane referenced by 96 in FIG. 1. The perspective of FIG. 1 is generally parallel to the plane of the surface 58. The plane 96 is normal to the surface 58. The axis of pivoting movement of the panel 38 is in the plane 96, which is substantially centered between the panel edges 54, 56.

Figure 2:
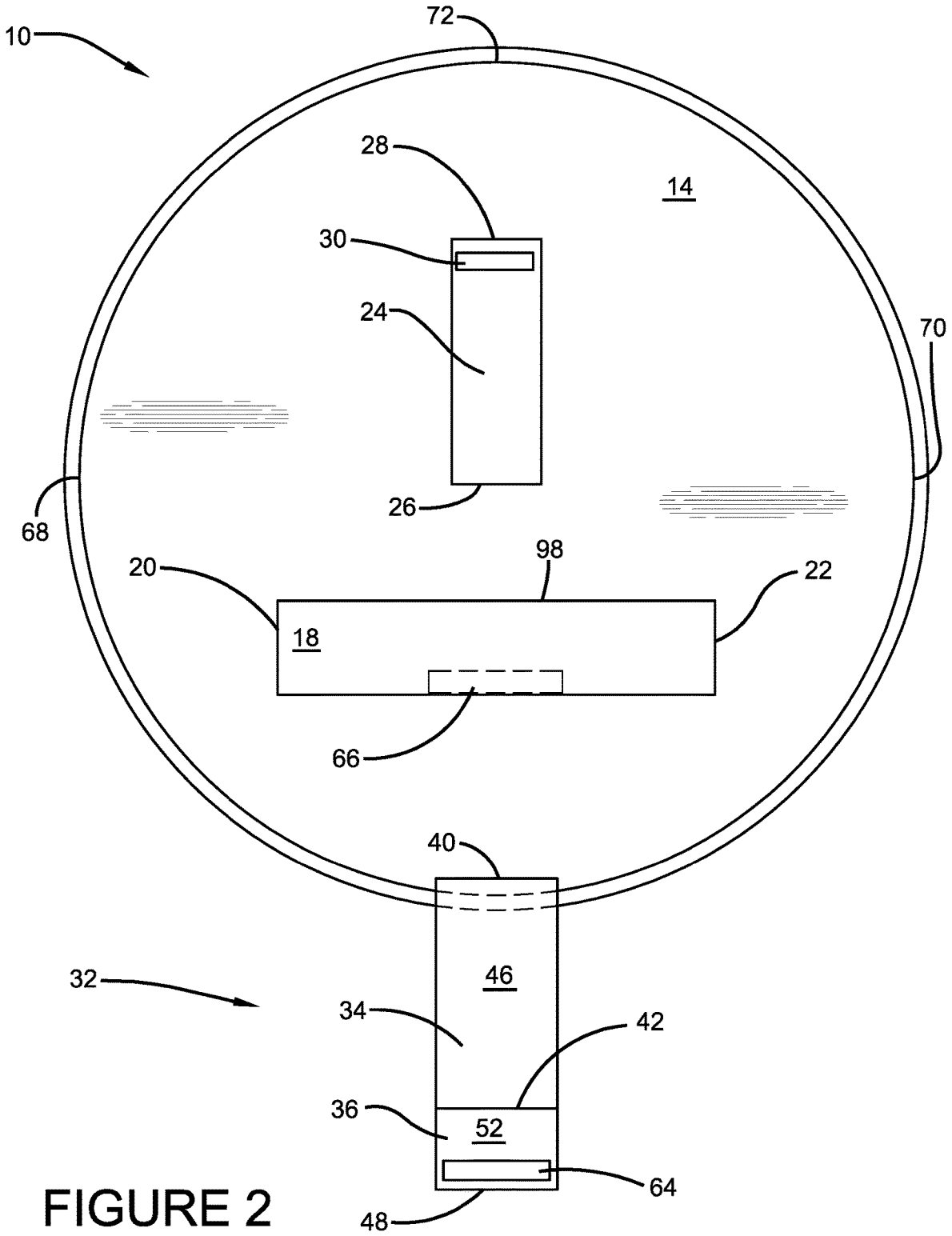
FIG. 2 is a second front view of the exemplary screen.

The end 48 can be releasably connectable to the primary exemplary panel 12, such as with matching patches of hook and loop fasteners. In the exemplary embodiment, a first patch 64 can be fixed on the end 48 and releasibly connect to a second patch 66 at the second position on the primary exemplary panel 12. The patch 66 can be positioned under the horizontal strap 18 and is therefore shown in phantom in FIG. 2.

In operation, the user can place the slip the screen 10 over the chairback 78, wherein the chairback 78 passes in between the primary exemplary panel 12 and the horizontal strap 18. The screen 10 can be lowered over the back of the chair until the top-most edge 88 of the chairback 78 is positioned above the upper edge 98 of the horizontal strap 18. The vertical strap 24 is then extended over the top-most edge 88 of the chairback 78 and connected to the horizontal strap 18.

Next, the exemplary second end 48 can be releasably connected to the primary exemplary panel 12, through the patches 64, 66. The outer surface 58 of the exemplary panel 38 contacts the back surface 76 of the chairback 78 and can pivot to accommodate differently configured chairs. The exemplary panel 38 does not contact the primary exemplary panel 12 when the exemplary brace assembly 32 is in operation. The exemplary panels 34, 36 do not contact the chairback 78 when the exemplary brace assembly 32 is in operation. As shown in the Figures, the first panel 34 and the second panel 36 are at angle of greater than zero degrees relative to one another when the second panel 36 is attached to the primary panel 12 at the second position 48. The exemplary panels 34, 36 define a V-shaped brace between the exemplary panel 38 and the primary exemplary panel 12 to support the exemplary panel 38 inhibit the primary exemplary panel 12 from tipping backward.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or subcombinations that are disclosed herein as other present disclosures in other patent documents is hereby unconditionally reserved. The use of the word "can" in this document is not an assertion that the subject preceding the word is unimportant or unnecessary or "not critical" relative to anything else in this document. The word "can" is used herein in a positive and affirming sense and no other motive should be presumed. More than one "invention" may be disclosed in the present disclosure; an "invention" is defined strictly by the content of a patent claim and not by what is written in a detailed description of an embodiment of an invention.

What is claimed is:

1. A screen mountable on a chairback of a chair comprising:

a primary panel having a front side and a back side, said primary panel extending laterally between first and second lateral edges, said primary panel extending vertically between top and bottom edges, said front side operable to confront and contact a back side of the chairback in operation, said primary panel sized to extend beyond at least part of a perimeter of the chairback in operation;

a horizontal strap fixed to said front side at first and second ends, said horizontal strap configured to extend laterally around a front side of the chairback in operation whereby the chairback is positioned between said horizontal strap and said primary panel in operation, said horizontal strap formed from elastic material whereby said horizontal strap is configured to elastically stretch around the chairback in operation;

a brace assembly fixed to said front side at a first brace end and extending to a second brace end, said first brace end of said brace assembly fixed to said front side at a first position closer to said bottom edge than at least part of said horizontal strap, said brace assembly configured to confront and contact the back side of the chairback in operation to urge said top edge forward, said second brace end selectively engageable with said front side at a second position spaced closer to said bottom edge than at least part of said horizontal strap, said second brace end is capable of being engaged with said front side in operation and is capable of being disengaged from said front side when not in operation; and wherein said brace assembly is configured to lay flat on said primary panel when not in operation, said brace assembly defines a length when lying flat, and said length is less than one-half a distance between said top edge and said bottom edge.

2. The screen of claim 1 wherein said primary panel is twice-foldable into a circular shape when not in operation and said brace assembly is sized to remain flat when said primary panel has been twice-folded.

3. The screen of claim 2 wherein at least one of said first brace end and said second brace end is closer to said top edge than at least part of said horizontal strap when said brace assembly is lying flat on said primary panel and said primary panel is unfolded.

4. A screen mountable on a chairback of a chair comprising:

a primary panel having a front side and a back side, said primary panel extending laterally between first and second lateral edges, said primary panel extending vertically between top and bottom edges, said front side operable to confront and contact a back side of the chairback in operation, said primary panel sized to extend beyond at least part of a perimeter of the chairback in operation;

a horizontal strap fixed to said front side at first and second ends, said horizontal strap configured to extend laterally around a front side of the chairback in operation whereby the chairback is positioned between said horizontal strap and said primary panel in operation, said horizontal strap formed from elastic material whereby said horizontal strap is configured to elastically stretch around the chairback in operation;

a brace assembly fixed to said front side at a first brace end and extending to a second brace end, said first brace end of said brace assembly fixed to said front side at a first position closer to said bottom edge than at least part of said horizontal strap, said brace assembly configured to confront and contact the back side of the chairback in operation to urge said top edge forward, said second brace end selectively engageable with said front side at a second position spaced closer to said bottom edge than at least part of said horizontal strap, said second brace end is capable of being engaged with said front side in operation and is capable of being disengaged from said front side when not in operation; and wherein said brace assembly further comprises:

a plurality of panels pivotally interconnected to one another.

5. The screen of claim 4 where at least two of said plurality of panels are interconnected to one another through a living hinge.

6. The screen of claim 4 wherein said plurality of panels further comprises a first panel and a second panel and a third panel pivotally interconnected to one another at a single living hinge.

7. The screen of claim 4 wherein at least one of said plurality of panels does not contact the chairback when said brace assembly is in operation.

8. The screen of claim 4 wherein said primary panel is twice-foldable into a circular shape when not in operation and said brace assembly contained within a perimeter of said primary panel when said primary panel has been twice-folded.

9. The screen of claim 4 further comprising:

first and second patches of hook and loop fasteners, said first patch mounted on said primary panel at one of said first position and said second position, said second patch mounted on said second brace end of said brace assembly, said first and second patches of hook and loop fasteners interconnecting said primary panel and said brace assembly when said brace assembly is in operation.

10. The screen of claim 4 further comprising:

a vertical strap fixed to said front side at a first strap end and extending to a second strap end, said vertical strap configured to extend vertically over a top of the chairback in operation whereby the top of the chairback is positioned between said vertical strap and said primary panel in operation, said vertical strap formed from elastic material whereby said vertical strap is configured to elastically stretch around the top of the chairback in operation.

11. The screen of claim 10 wherein said second strap end of said vertical strap is further defined as selectively engageable with said horizontal strap, said vertical strap releasably fixed with said horizontal strap in operation.

12. The screen of claim 10 wherein said first strap end of said vertical strap and said first brace end of said brace assembly are positioned on opposite sides of said horizontal strap.

13. A screen mountable on a chairback of a chair comprising:

a primary panel having a front side and a back side, said primary panel extending laterally between first and second lateral edges, said primary panel extending vertically between top and bottom edges, said front side operable to confront and contact a back side of the chairback in operation, said primary panel sized to extend beyond at least part of a perimeter of the chairback in operation;

a horizontal strap fixed to said front side at first and second ends, said horizontal strap configured to extend laterally around a front side of the chairback in operation whereby the chairback is positioned between said horizontal strap and said primary panel in operation, said horizontal strap formed from elastic material whereby said horizontal strap is configured to elastically stretch around the chairback in operation;

a brace assembly fixed to said front side at a first brace end and extending to a second brace end, said first brace end of said brace assembly fixed to said front side at a first position closer to said bottom edge than at least part of said horizontal strap, said brace assembly configured to confront and contact the back side of the chairback in operation to urge said top edge forward, said second brace end selectively engageable with said front side at a second position spaced closer to said bottom edge than at least part of said horizontal strap, said second brace end is capable of being engaged with said front side in operation and is capable of being disengaged from said front side when not in operation; and wherein said second position at which said brace assembly selectively connects to said primary panel is positioned between said primary panel and said horizontal strap.

14. A screen mountable on a chairback of a chair comprising:

a primary panel having a front side and a back side, said primary panel extending laterally between first and second lateral edges, said primary panel extending vertically between top and bottom edges, said front side operable to confront and contact a back side of the chairback in operation, said primary panel sized to extend beyond at least part of a perimeter of the chairback in operation;

a horizontal strap fixed to said front side at first and second ends, said horizontal strap configured to extend laterally around a front side of the chairback in operation whereby the chairback is positioned between said horizontal strap and said primary panel in operation, said horizontal strap formed from elastic material whereby said horizontal strap is configured to elastically stretch around the chairback in operation;

a brace assembly fixed to said front side at a first brace end and extending to a second brace end, said first brace end of said brace assembly fixed to said front side at a first position closer to said bottom edge than at least part of said horizontal strap, said brace assembly configured to confront and contact the back side of the chairback in operation to urge said top edge forward, said second brace end selectively engageable with said front side at a second position spaced closer to said bottom edge than at least part of said horizontal strap, said second brace end is capable of being engaged with said front side in operation and is capable of being disengaged from said front side when not in operation; and wherein said brace assembly further comprises:

a first member defining said first brace end of said brace assembly and extending a first length to an intermediate end;

a second member defining said second brace end of said brace assembly and extending a second length to said intermediate end, said first member and said second member interconnected to one another at said intermediate end for relative pivoting movement, said first member and said second member at angle of greater than zero degrees relative to one another when said second member is attached to said primary panel at said second position; and a third member engaged with at least one of said first member and said second member, said third member defining a substantially planar surface configured to engage the back side of the chairback in operation, said third member pivotally attached to said at least one of said first member and said second member whereby said planar surface is operable to pivot in response to a configuration of the back side of the chairback to lie flush with the back side of the chairback.

15. The screen of claim 14 wherein said first member is engaged with said primary panel for pivoting movement about a first axis, said third member is engaged with said at least one of said first member and said second member for pivoting movement about a second axis, and wherein said first axis and said second axis are parallel to one another.

16. The screen of claim 14 wherein said planar surface extends laterally between first and second panel edges to define a width and extends between third and fourth panel edges to define a height, said second axis is in a plane substantially centered between said third and fourth panel edges of said planar surface.

17. The screen of claim 14 wherein said third member is engaged with both of said first member and said second member at said intermediate end, each of said third member and said first member and said second member pivotal relative to the other two members.

18. The screen of claim 17 wherein said brace assembly further comprises:

a living hinge at said intermediate end.

* * * * *